United States Patent [19]

Turcott et al.

[11] Patent Number: 4,637,539

[45] Date of Patent: Jan. 20, 1987

[54] ANCHOR BOLT INSTALLATION TOOL WITH DEPTH STOP

[76] Inventors: James L. Turcott, 93 Grananda Calle, Grandbury, Tex. 76048-1468; Rodney C. Matheny, 433 N. Joliet, Kennewick, Wash. 99336

[21] Appl. No.: 648,988

[22] Filed: Sep. 10, 1984

[51] Int. Cl.[4] ..... B25C 1/18; B25D 17/06

[52] U.S. Cl. ..... 227/156; 173/128; 408/241 S; 227/142; 227/147

[58] Field of Search ..... 227/9, 10, 107, 139, 227/140, 142, 147, 149, 156; 29/275, 277; 81/463; 279/79; 408/241 S; 173/128, 90; 145/30, 46; 81/23, 24, 27, 44

[56] References Cited

U.S. PATENT DOCUMENTS

| | | | |
|---|---|---|---|
| 493,758 | 3/1893 | Davidson | 145/46 |
| 919,924 | 4/1909 | McQuaide | 72/481 X |
| 1,033,362 | 7/1912 | Walker | 279/79 X |
| 1,333,881 | 3/1920 | Stine | 145/46 |
| 3,074,719 | 1/1963 | McKee | 227/142 |
| 3,104,396 | 9/1963 | Termet | 227/149 |
| 3,290,822 | 12/1966 | Mauget | 29/275 |
| 4,521,145 | 6/1985 | Bieler | 408/241 S X |

FOREIGN PATENT DOCUMENTS

| | | | |
|---|---|---|---|
| 1194593 | 11/1959 | France | 227/149 |
| 1004305 | 9/1965 | United Kingdom | 227/147 |

*Primary Examiner*—Robert L. Spruill
*Assistant Examiner*—Taylor J. Ross
*Attorney, Agent, or Firm*—Wells, St. John & Roberts

[57] ABSTRACT

An anchor bolt installation tool for installing anchor bolts in preformed holes in concrete, masonry and other materials. The anchor bolt installation tool includes a body piece adapted to interengage with a power impact hammer at one end. The exterior of the body piece is preferably threaded to adjustably receive a guide piece thereon. The body piece is further provided with a bolt receptacle for receiving the threaded end of an anchor bolt. The guide piece is adjusted relative to the body piece so that the guide piece contacts the surface of the concrete or other structure thereby determining the depth to which the anchor bolt is driven. Locking means are preferably provided to fix the relative position between the guide piece and body piece to maintain the depth adjustment at a fixed position. A plurality of inserts can also be provided so that various sizes and types of anchor bolts can be used.

4 Claims, 8 Drawing Figures

ANCHOR BOLT INSTALLATION TOOL WITH DEPTH STOP

TECHNICAL FIELD

The technical field of this invention is tools for use with power impact hammers for holding and driving anchor bolts to a predetermined depth.

BACKGROUND OF THE INVENTION

It is common in the construction trades to use anchor bolts to mount structural pieces and fixtures to concrete, masonry and other materials. Anchor bolts are made in a variety of types but are commonly installed by first drilling a cylindrical hole in the concrete or other material in which the anchor bolt is being installed. The holes drilled for receiving the anchor bolts are usually drilled to a specific size determined by the size of the anchor bolt being installed therein. The anchor bolts are then driven into the holes. The driving of the anchor bolts into the hole or the subsequent tightening of the nut upon the anchor bolt causes the anchor bolt to swage outwardly or otherwise form a tight connection between the anchor bolt and the surrounding concrete or other material.

For relatively small sized anchor bolts having diameters less than ¾", it is relatively easy for the anchor bolts to be driven inwardly using a one or two pound hammer. For larger size anchor bolts, it becomes necessary to use heavy sledge hammers and considerable amounts of driving force to install the anchor bolts. Installation of anchor bolts using sledge hammers creates several problems. The first problem is that the sledge hammers typically damage the threads present on the exterior end of the anchor bolt. This problem has been obviated by using either a single nut or double nut threaded onto the end of the bolt so that the sledge hammer strikes the nut and does not mar the threads. This installation technique causes all of the driving force to be transmitted through the nut, threads of the nut, and then the threads of the bolt. In difficult installations, this impact loading of the threads can cause mechanical distortion and possibly mechanical failure of the threads themselves.

Installation of large anchor bolts using sledge hammers also is physically demanding, requiring that a person swing a relatively heavy, such as 12 pound, sledge hammer in a variety of positions. Installation of the anchor bolts in overhead locations is particularly difficult, especially where installation is high above ground and in cramped quarters.

Another problem associated with the sledge hammer technique for installing anchor bolts is that it is very difficult for the anchor bolt to be driven to a precise depth within the receiving hole. Precise depth location is desirable since the anchor bolts are preferably installed as deeply as possible within the receiving hole while still providing a sufficient number of anchor bolt threads to allow a structural plate or other fixture together with any washers and the anchor bolt nut to be positioned over the anchor bolt shank and then be tightened. It is desirable to leave approximately two exposed threads at the end of the installed anchor bolt to obtain maximum bolt performance without leaving unnecessary amounts of bolt extending beyond the nut, thereby creating potential for bending the bolt or marring the threads.

Drilling a receiving hole for an anchor bolt in concrete and masonry usually involves using a power impact hammer/drill tool which is well known in the construction trades. It is desirable that this impact hammer/drill tool also be used to perform the driving of the anchor bolt into the receiving hole. Heretofore, there has been no tool or adaptor which allowed a power impact hammer/drill tool to be used in this fashion.

It is an object of this invention to provide an anchor bolt installation tool which will allow anchor bolts to be driven into preformed receiving holes to a predetermined depth using a power impact hammer/drill tool.

These and other objects and advantages of the invention will be apparent from the detailed description given herein.

BRIEF DESCRIPTION OF THE DRAWINGS

The invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 2:
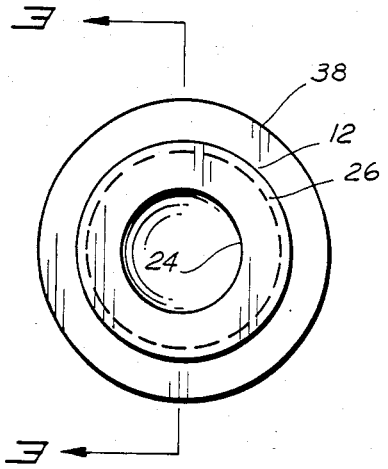
FIG. 2 is an end elevational view of the tool shown in FIG. 1.
Figure 1:
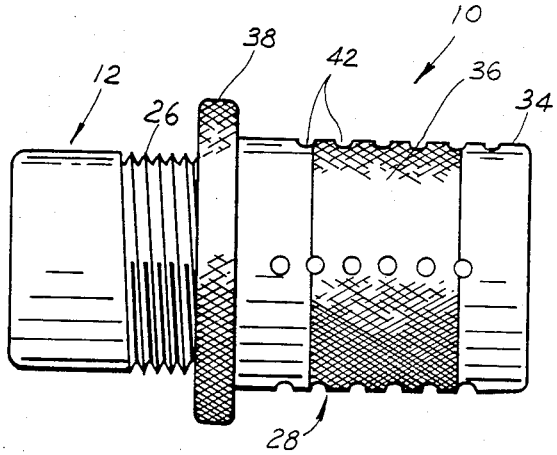
FIG. 1 is a side elevational view of a tool constructed according to the invention.

FIG. 1 shows a preferred form of anchor bolt installation tool 10 according to this invention. Anchor bolt installation tool 10 comprises a body piece 12 having a bolt end 14 and a driver end 16 (see FIG. 3). Bolt end 14 is provided with a bolt receptacle 18 with interior threads 19 for receiving the threads of an anchor bolt 20 therein (see FIGS. 6–8).

Figure 3:
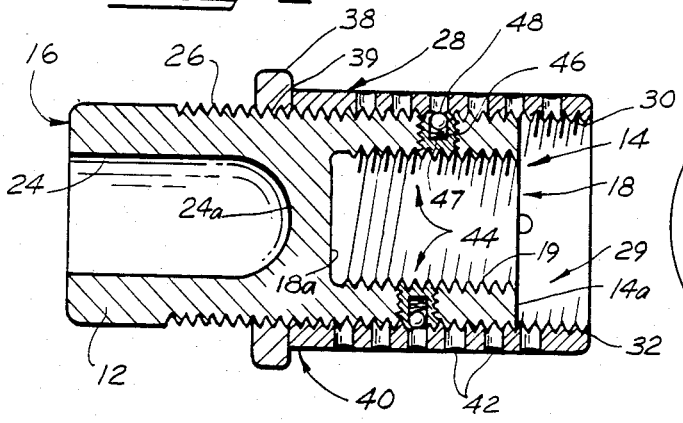
FIG. 3 is a side sectional view taken along line 3—3 of FIG. 2.
Figure 4:
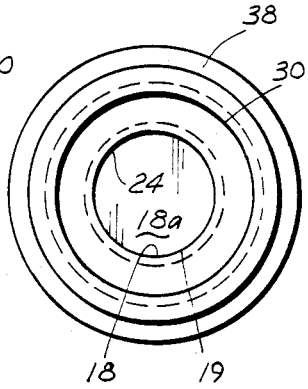
FIG. 4 is an end elevational view of the bolt end of the tool shown in FIGS. 1 and 3.
Figure 6:
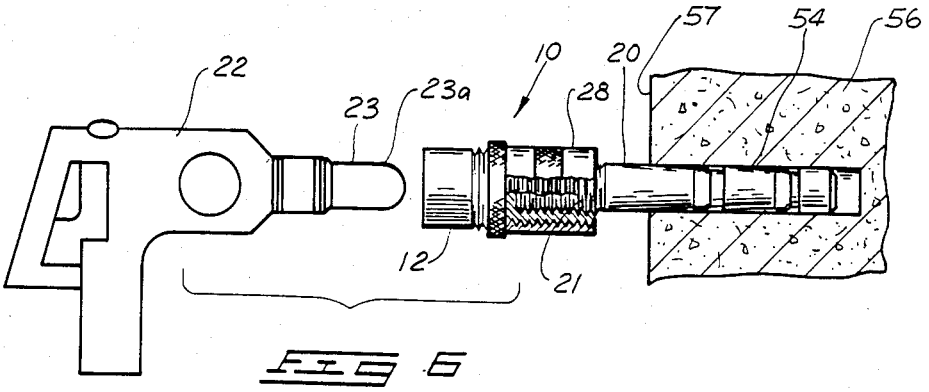
FIG. 6 is an exploded side elevational view showing the tool of FIG. 1 connected to an anchor bolt which is being installed in concrete using a power impact hammer/drill tool, portions have been broken away and are shown in cross section.

The driver end 16 of body piece 12 is adapted for interengaging with an impact driving means such as a power impact hammer/drill tool 22 (see FIG. 6). FIG. 3 shows that body piece 12 can be advantageously adapted for use with an impact driving means by providing a driver receptacle 24. Driver receptacle 24 is preferably constructed with a hemispherical receptacle end **24*a* in order to better distribute the impact forces to body piece 12. Impact hammer/drill power tool 22 can be provided with a bit 23 having a similarly shaped hemispherical end 23*a*. Bit 23 is received within receptacle 24** preferably providing only a small amount of clearance so that a reasonably tight fit is achieved.

Anchor bolt installation tool 10 also comprises a guide piece 28 having an interior bore 29 which is preferably provided with interior threads 30. Interior threads 30 are threadably received upon exterior threads 26 formed about the exterior of body piece 12 starting from the bolt end 14 extending towards the driver end 16. Exterior threads 26 advantageously extend sufficiently far toward driver end 16 so that the guide piece 28 can be threaded totally onto body piece 12 so that the guide piece contact end 32 is even with the bolt end face 14*a* of body piece 12.

Guide piece 28 can advantageously be formed with a cylindrical exterior surface 34 (FIG. 1). It is also equally possible that exterior surface 34 can be hexagonal, octagonal, square or some other advantageous shape. Exterior surface 34 is also preferably provided with knurling 36 to provide better finger grip when the guide piece is being adjusted relative to the body piece.

Figure 5:
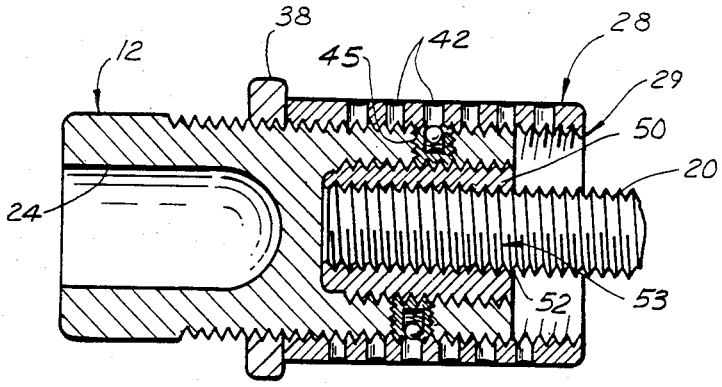
FIG. 5 is a side sectional view similar to FIG. 3 further showing a threaded insert and portion of an anchor bolt received within the bolt end of the tool.

Anchor bolt installation tool 10 is also advantageously provided with a locking means to fix the relative position of guide piece 28 upon body piece 12. FIGS. 1, 3 and 5 show two alternative locking means which can be used. The first such locking means comprises a jam ring 38. Jam ring 38 is provided with interior threads 39 which are threadably received upon the exterior threads 26 of body piece 12. Jam ring 38 is operated by first adjusting the position of guide piece 28 upon body piece 12. Jam ring 38 is then threaded towards the guide piece 28 so that it contacts the interior end 40 of guide piece 28. Tightening of jam ring 38 against interior end 40 locks the position of guide piece 28 relative to body piece 12.

An alternative locking means for fixing the relative position of guide piece 28 upon body piece 12 is also shown in the Figs. This alternative locking means comprises a plurality of locking apertures 42 formed through or into the side walls of guide piece 28. Locking apertures 42 are preferably positioned at regularly spaced locations along the guide piece so that locking can occur at regular positions of guide piece 28. Relative motion between body piece 12 and guide piece 28 is prevented by using ball locks 44 mounted within the sidewalls of body piece 12 adjacent to locking apertures 42. Ball locks 44 are well known in the art but will be herein described more fully.

Ball locks 44 comprise an exterior casing 45 having a central recess 46 therein. A small spring 47 and ball 48 are positioned within recess 46 and then casing 45 is swaged so that the ball and spring are held within central recess 46.

Guide piece 28 is positioned on body piece 12 so that ball locks 44 are adjacent to an appropriate locking aperture 42. In this position, the small balls 48 are received within apertures 42 thereby preventing relative rotation between the guide piece 28 and body piece 12 unless substantial torque is applied. Since the locking means is designed to prevent motion caused by the vibration resulting from power tool 22, little torque is generated by such vibration and the locking means effectively fixes the relative position of guide piece 28. Twisting by hand is sufficient torque to provide easy adjustment of the position of guide piece 28.

In addition to the two locking means described above, there are other alternative locking means which can fix the relative positions between the guide piece and body piece. It is also possible to use the two alternative locking means described above in combination to assure more positive locking, or to use either of the above alternatives with another possible alternative which may be known in the art or hereafter developed.

Interior threads 19 of bolt receptacle 18 can be chosen from a wide variety of thread types and sizes. Manufacture of tool 10 necessarily requires that only one size and type be incorporated into any particular tool. To allow varying sizes and types of anchor bolts to be installed using the same tool, it is advantageous to provide various sized bolt inserts 50 which are shown in FIG. 5. Bolt inserts 50 are provided with exterior threads which are properly sized to fit within the interior threads 19 of the bolt receptacle 18. Bolt inserts 50 are also provided with a bolt receptacle 53 with interior threads 52 which are sized to receive the particular anchor bolt 20 being installed. Installation tool 10 can come equipped with a plurality of bolt inserts 50 each having a different diametrical size or thread type as necessary to accommodate the particular range of anchor bolts 20 being installed.

Figure 7:
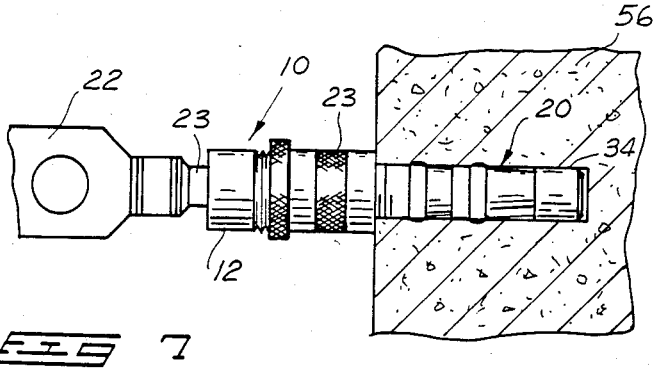
FIG. 7 is similar to FIG. 6 except that the impact hammer has been inserted into the anchor bolt installation tool of FIG. 1, and the anchor bolt has been driven into final position within the receiving hole formed in the concrete.
Figure 8:
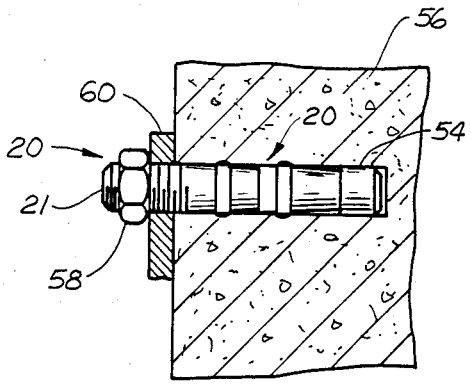
FIG. 8 is similar to FIGS. 6 and 7 showing the anchor bolt in its final installed position.

FIGS. 6 through 8 show the typical sequence for installing an anchor bolt 20 using the installation tool 10 according to this invention. The first step in installation is to form a cylindrical receiving hole 54 within the concrete, masonry, or other structure 56 in which the anchor bolt is being mounted. Receiving hole 54 can advantageously be formed using a power impact hammer/drill tool 22 equipped with an appropriate masonry drill bit (not shown) of the appropriate size. Once receiving hole 54 is properly formed, it is then desirable to install anchor bolt 20 therein. Anchor bolt 20 is first freed of any nut such as nut 58 (FIG. 8) and threaded into the bolt receptacle 18 or bolt receptacle 53 in insert 50. Guide piece 28 is then adjusted so that the contact face 32 will bear against the exterior surface 57 of structure 56 when a proper amount of bolt 20 is extending beyond surface 57. Adjustment of guide piece 28 is accomplished by rotating and hence threading it relative to body piece 12 so that the guide piece contact face is either extended or retracted relative to body piece 12.

Anchor bolt 20 is connected to body piece 12 by screwing the anchor bolt threads 21 into bolt recess 18 preferably until the end of the bolt contacts the bolt recess front wall 18*a* (FIG. 3). Contact of bolt 20 with front wall 18*a* has the advantage of transferring all of the driving impact forces directly from body piece 12 to the bolt without depending upon the threads of the anchor bolt to carry the load. Since the load will be effectively shared between the end of anchor bolt 20 and the threads of the anchor bolt, the overall impact forces are equalized over the end of the bolt, thereby preventing deformation of either the bolt end or the bolt threads.

Once anchor bolt 20 is properly held within bolt receptacle 18, it is possible to install the bolt within receiving hole 54. Recognize that it is also possible to first start anchor bolt 20 into receiving hole 54 and then to screw the installation tool onto the anchor bolt threads 21 in place. With the anchor bolt initially started in hole 54 and the installation tool properly installed on the end of the anchor bolt, it is then possible to use power tool 22 to provide repeated impact forces thereby driving the anchor bolt further into the receiving hole 54. Anchor bolt 20 is driven into receiving hole 54 until the contact face 32 of guide piece 28 contacts the exterior surface 57 of structure 56. At this point the anchor bolt is properly installed to the desired predetermined depth within receiving hole 54. Power tool 22 is then removed from tool 10 and tool 10 is threaded off of the end of anchor bolt 20. The structural plate or other fixture 60 (see FIG. 8) being installed is then positioned over the anchor bolt and the installation nut 58 is threaded onto bolt 20 in order to hold the plate in place against structure 56.

It is possible to construct the installation tool 10 from a variety of materials of construction. It is preferable that the installation tool be made of steel in order to cost effectively provide the durability necessary to withstand the repeated impacts from power tool 22. It is also possible to use alternative materials for construction particularly various metals and metal alloys. It is also possible that any of these potential materials of construction can be specifically heat treated, case hardened or otherwise further conditioned to provide greater durability during use under this repeated impact service.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An anchor bolt installation tool for use with an impact driving means for installing an anchor bolt to a specified depth within a previously formed receiving hole in concrete or other material, comprising:

a cylindrical body piece having a longitudinal axis, a bolt end and a driver end, the bolt end having a threaded bolt recess formed therein along the longitudinal axis for threadably receiving the anchor bolt therein, said threaded bolt recess having a front wall for contacting end surfaces of the anchor bolt; said driver end having a driver receptacle formed therein along the longitudinal axis for receiving portions of the impact driving means therein, said driver receptacle having a receptacle end wall, said body piece being solid between said receptacle end wall and said front wall of the threaded bolt recess, said body piece having exterior threads formed thereon;

a cylindrical guide piece having internal threads which are adjustably and threadably received upon the exterior threads of the body piece and adjustably extendible beyond the bolt end thereof so as to engage an exposed surface of the material into which the anchor bolt is being installed, thereby determining the depth to which the anchor bolt is driven;

a jamb ring threadably received upon the exterior threads of the body piece for engaging the guide piece and maintaining the position thereof; and locking means for fixing the relative position of the guide piece upon the body piece.

2. The anchor bolt installation tool of claim 1 wherein the guide piece further includes a plurality of locking apertures formed transversely therethrough, and wherein the locking means includes at least one ball lock resiliently mounted in the body piece for biased extension into the locking apertures of the guide piece.

3. The anchor bolt installation tool of claim 1 wherein said driver receptacle end wall is hemispherical.

4. The anchor bolt installation tool of claim 1 further comprising at least one anchor bolt insert having threaded exterior surfaces for being received within the threaded recess of the body piece; and further having internal threads for receiving threads of an anchor bolt therein, so that various sizes and types of anchor bolts can be installed.

* * * * *